United States Patent [19]

Snyder et al.

[11] 3,990,741

[45] Nov. 9, 1976

[54] MODULAR TANDEM STRUCTURE

[75] Inventors: Bobbie L. Snyder, Kansas City, Mo.; James L. Gerner, Shawnee Mission, Kans.

[73] Assignee: Fixtures Manufacturing Corporation, Kansas City, Mo.

[22] Filed: May 16, 1975

[21] Appl. No.: 578,133

[52] U.S. Cl. ..... 297/248

[51] Int. Cl.[2] ..... A47C 15/00

[58] Field of Search ..... 108/64, 114; 297/135, 297/157, 232, 243, 248, 249; 248/188, 188.8; 403/388, 391

[56] References Cited

UNITED STATES PATENTS

| | | | |
|---|---|---|---|
| 2,351,858 | 6/1944 | Ingalls | 403/389 X |
| 3,188,138 | 6/1965 | Lockshin | 297/248 |
| 3,261,640 | 7/1966 | Straits | 297/135 |
| 3,494,662 | 2/1970 | Schaefer et al. | 297/248 |
| 3,885,766 | 5/1975 | Resch et al. | 297/232 X |

*Primary Examiner*—James C. Mitchell

*Attorney, Agent, or Firm*—Fishburn, Gold & Litman

[57] ABSTRACT

A tandem structure including chairs and the like formed of modular assemblies each comprising a generally horizontal load supporting member, such as a chair seat portion, table top, or the like, mounted on a fastening structure connected to an upper portion of a leg member which has a base portion engageable with a support surface or floor. The modular assemblies are each connected to another for cooperative support by elongated connection members which extend therebetween and each beam member has opposite end portions thereof removably secured to the fastening structure of the respective modular assembly.

6 Claims, 7 Drawing Figures

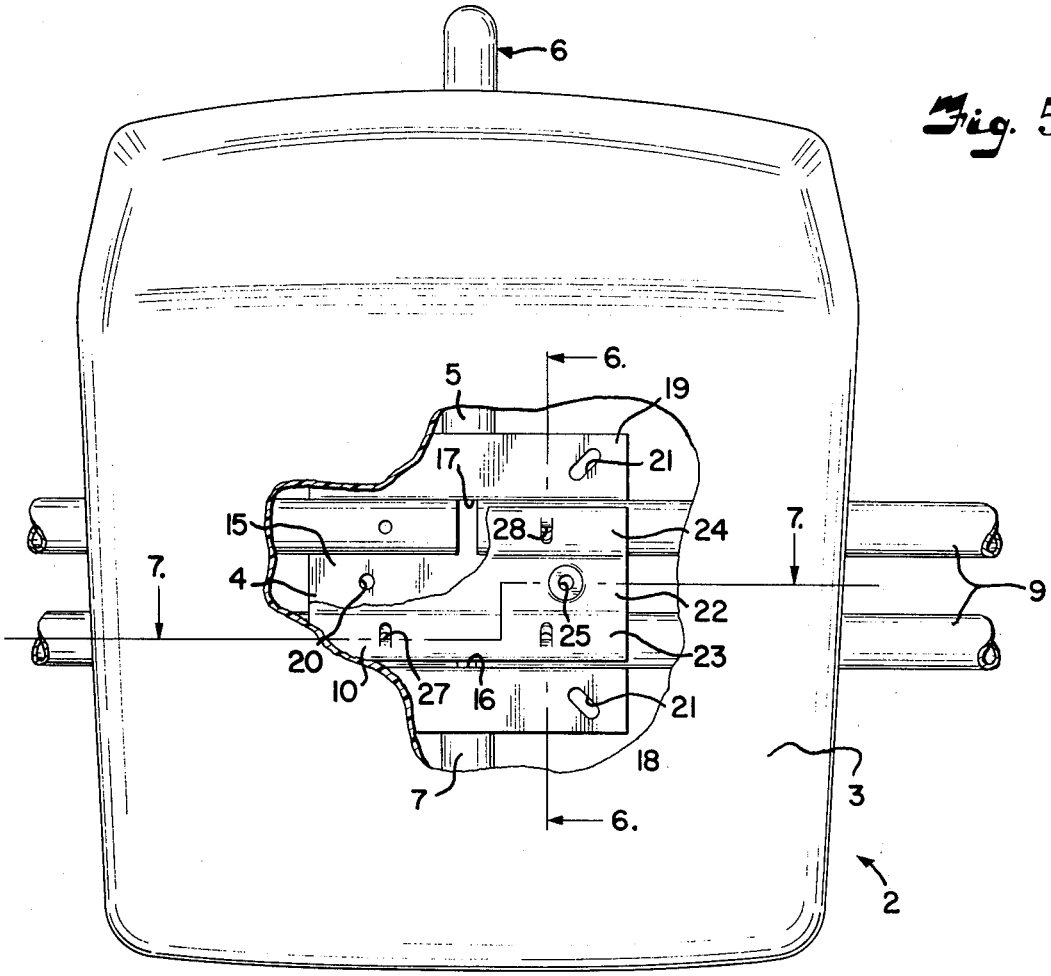
Fig. 5.
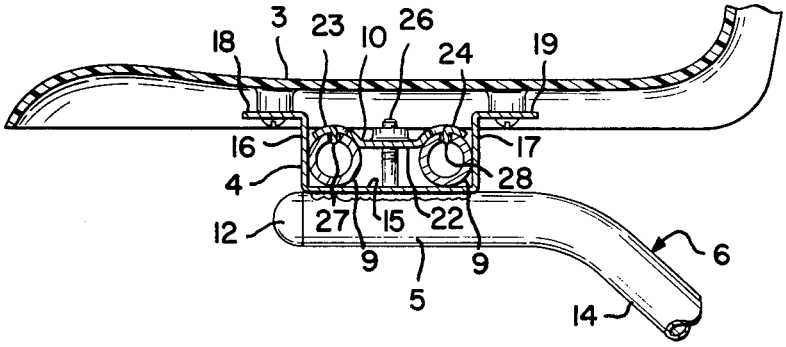
Fig. 6.
Fig. 7.
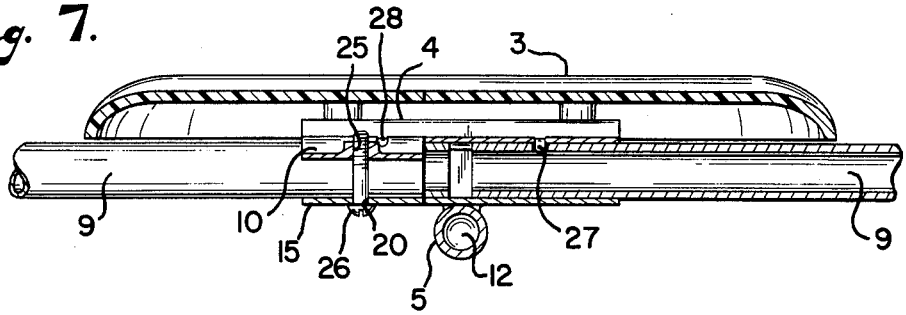

MODULAR TANDEM STRUCTURE

The present invention relates to tandem structures and more particularly to tandem structures including chairs and the like formed of modular assemblies connected together by horizontally extending connection members.

The principal objects of the present invention are: to provide a tandem structure including chairs and the like formed of modular assemblies connected together in a unit; to provide such a tandem structure wherein the modular assemblies therefor each have a plurality of easily assembled components; to provide such a modular assembly for tandem structures having one leg per assembly and connection members extending normal to the leg for connecting and spacing generally horizontal load support members, such as chair seat portions, table tops, or the like; to provide such a tandem structure which is light in weight and easily moved; to provide such a tandem structure having versatile connecting members adapted to go around columns or pillars, turn corners, and join into itself for back-to-back units; to provide such a structure with substantially parallel elongated connector members that is stable but with a flexibility whereby the legs will properly rest on uneven floors or surfaces; and to provide such a tandem structure and modular assemblies therefor which are attractive in appearance, economical to manufacture, durable in construction, and particularly well adapted for the proposed use.

Other objects and advantages of this invention will become apparent from the following description taken in connection with the accompanying drawings wherein are set forth, by way of illustration and example, certain embodiments of this invention.

The drawings constitute a part of the specification and include an exemplary embodiment of the present invention and illustrate various objects and features of the modular tandem chair unit.

FIG. 5 is an enlarged fragmentary plan view of the structure with portions broken away to better illustrate component parts thereof.

FIG. 6 is an enlarged transverse sectional view taken on line 6—6 of FIG. 5.

FIG. 7 is an enlarged longitudinal sectional view taken on line 7—7 of FIG. 5.

Figure 1:
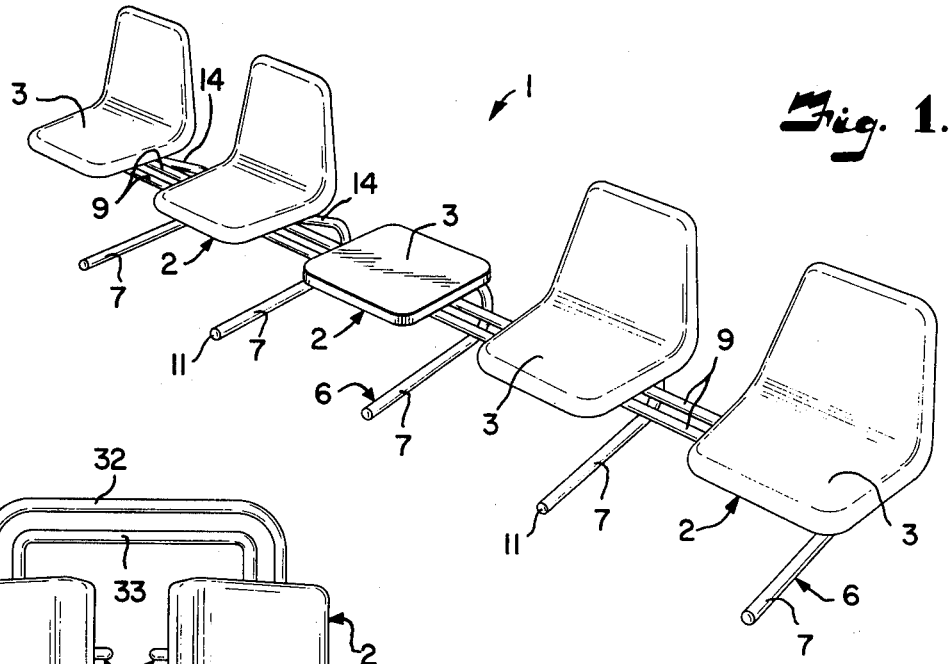
FIG. 1 is a perspective view of a tandem structure having modular assemblies embodying features of the present invention.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure.

In the disclosed embodiment of the present invention, the reference numeral 1 designates generally a tandem structure including chairs and the like formed of a plurality of modular assemblies 2 each having a generally horizontal load supporting member 3, such as a chair seat portion, table top, or the like, on a mounting structure shown as having a first bracket portion 4 connected to an upper portion 5 of a leg member 6, said leg member having a base portion 7 engageable with a support surface 8. Connection members or beams 9 extend between respective adjacent modular assemblies 2 and have each of opposite end portions thereof retained in engagement with the mounting structure as by clamping to the first bracket portion 4 by a respective second bracket portion 10 thereof. The mounting structure forms the supporting connections between the leg member 6, load supporting member 3 and the connection members 9.

A leg member 6 is provided for each modular assembly 2 and may be of any suitable shape. The base portion 7 of the leg member 6 is in engagement with the support surface 8 and is of sufficient length and strength to support with stability, the modular assembly 2. In the illustrated structure, the base portion 7 is an elongated member arranged to maintain the upper portion 5 in a substantially horizontal position. The base portion 7 may have spaced glides or pads on a lower surface thereof. In the illustrated structure, the base portion 7 is a tubular member and has an end plug 11 in one end thereof to provide a finished appearance.

The upper portion 5 of the leg member 6 may be any suitable shape to support the first bracket portion 4 thereon. In the illustrated structure, the upper portion 5 is a generally tubular elongated member and has an end plug 12 in the end thereof to provide a finsihed appearance. The upper portion 5 and the base portion 7 of the leg member 6 may be connected in any desired manner. In the illustrated structure, the leg member 6 is a continuous member having an intermediate portion 14 extending between the base portion 7 and the upper portion 5 to define a generally U-shaped member.

The first bracket portion 4 has an intermediate portion thereof connected to the upper portion 5 of the leg member 6. The first bracket portion 4 is normal to the leg member and has opposite end portions positioned on respective opposite sides of the leg member 6.

In the illustrated structure, the first bracket portion 4 has a generally horizontal web portion 15 connected to the upper portion 5 of the leg member 6. The first bracket portion 4 has opposed leg portions 16 and 17 extending upwardly from the web portion 15 to define a channel shaped member. The leg portions 16 and 17 have flange portions 18 and 19 extending outwardly therefrom and adapted to have the load supporting member 3 mounted thereon.

The web portion 15 has a longitudinal axis substantially perpendicular to a longitudinal axis of the upper portion 5 of the leg member 6. The web portion 15 has a plurality of apertures 20 spaced along the longitudinal axis thereof, for a purpose later described. The flange portions 18 and 19 each have a plurality of apertures 21 therein adapted to receive suitable fastening members for mounting the load supporting member 3 thereon.

The second bracket portion 10 is positioned between the leg portions 16 and 17 of the first bracket portion 4 and is in engagement with end portions of the connecting members 9, as best seen in FIGS. 6 and 7. The second bracket portion 10 has a center portion 22 and suitably shaped side edge portions 23 and 24 engaging the leg portions 16 and 17 respectively. The connection or beam members 9 may be any desired shape, however, the connection members are illustrated as circular to be received in the respective side edge portions of the second bracket portions 10. The center portion 22 of the second bracket portion 10 has a plurality of spaced apertures 25 therein and is on a longitudinal axis of the second bracket portion 10. The apertures 25 are alignable with the apertures 20 in the web portion 15 of the first bracket portion 4 to receive suitable fastening members, such as screws or bolts 26, for holding end portions of the connecting members 9 in clamped engagement between the first and second bracket portions 4 and 10. In the illustrated structure, the apertures 25 are defined by upstanding portions.

The second bracket portion 10 and the end portions of the beam members 9 have interengaging means to hold same against relative movement.

In the illustrated structure, the side edge portions 23 and 24 each have a plurality of projections 27 and 28 respectively depending therefrom. Each of the opposite end portions of the connecting members 9 have a plurality of apertures or recesses in an upper surface thereof which are adapted to receive respective projections depending from the second bracket portion 10. The projections and apertures hold adjacent modular assemblies against relative movement therebetween. The apertures are larger circumferentially than the projections to provide some limited rotative movement of the beams in the brackets.

The end portions of each of the beam members 9 engage the web portion 15 and a respective one of the leg portions 16 or 17 of the first bracket portion 4 to thereby provide a stable structure.

The connection or beam members 9 effect spacing between adjacent load supporting members 3. The connection members 9 are preferably perpendicular to the longitudinal axis of the leg members 6, however, intermediate portions of the connecting members 9 may be arcuate, at an angle relative to the leg member, shaped to extend around columns or pillars, or U-shaped in plan view for use in joining back-to-back units together.

The load supporting members 3 are illustrated as a seat portion of a chair or the like, however, a table top may be positioned between adjacent chairs and suitably secured to the flange portions 18 and 19 of the first bracket portions 4.

Figure 2:
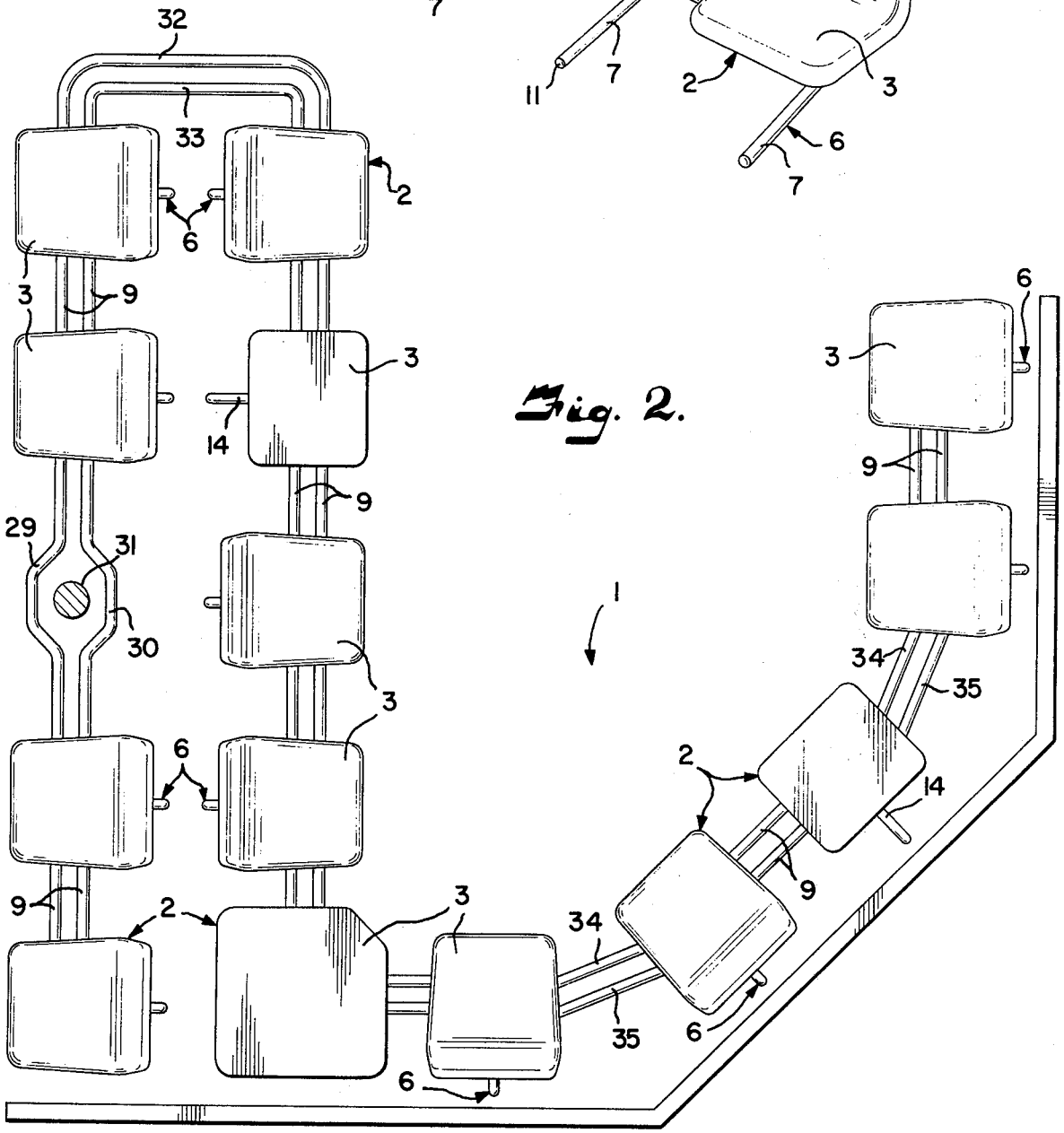
FIG. 2 is a plan view of the tandem structure showing an arrangement of modular assemblies.
Figure 3:
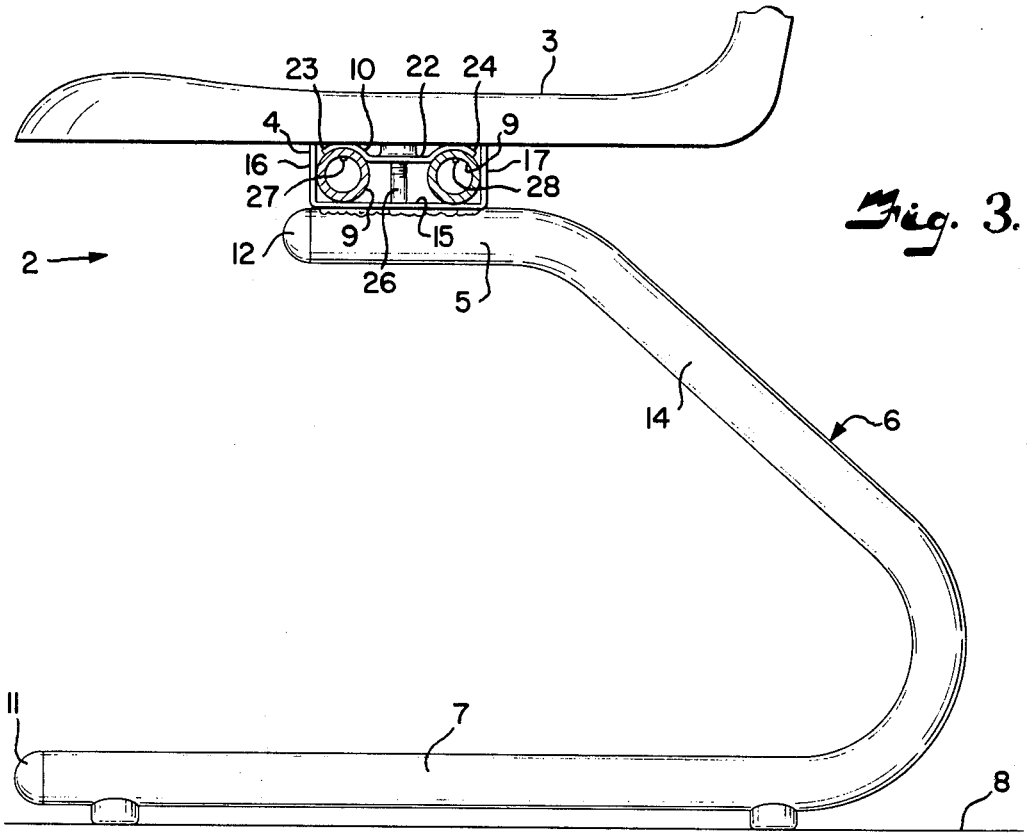
FIG. 3 is an enlarged fragmentary end elevational view of the tandem structure.
Figure 4:
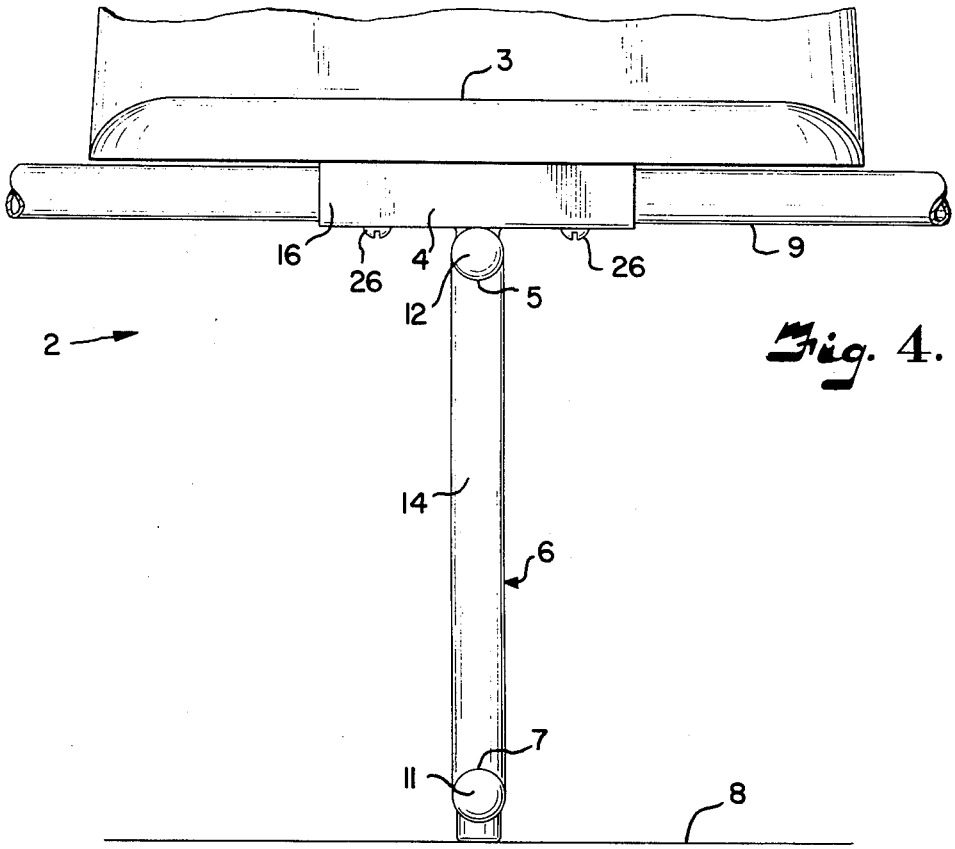
FIG. 4 is an enlarged fragmentary front elevational view of the tandem structure showing one module.

The beam members 9 are substantially rigid members and cooperate with the leg members 6 in a manner such that one leg complements the next adjacent leg to define a stable structure when resting on a supporting surface. The beam members 9 preferably are subject to torsion with some flexibility permitting the legs to rest on an uneven surface with stability. As best seen in FIGS. 2 and 5, the beam members 9 are arranged in pairs and each pair extends between adjacent first bracket portions 4.

FIG. 2 illustrates various shapes of beam members 9. The beam members 9 are substantially parallel and center or intermediate portions 29 and 30 of one pair of beam members are adapted to extend around a pillar or column 31. Center or intermediate portions 32 and 33 of another pair of beam members are U-shaped in plan view for joining back-to-back structures together. Center or intermediate portions 34 and 35 of a corner pair of beam members are at an angle relative to opposite end portions of the beam members.

It is to be understood that although I have illustrated and described one form of my invention, it is not to be limited to this specific form or arrangement of parts herein described and shown.

What I claim and desire to secure by Letters Patent is:

1. A modular tandem furniture structure including:

a. a plurality of leg members in spaced apart relation and with each having an elongate base portion and an upper portion with a connecting portion therebetween and all of said portions of each leg being substantially in an upright plane;

b. a mounting structure on and connected to the upper portion of each leg;

c. a plurality of horizontally extending elongate connecting members, said connecting members being arranged with at least two spaced apart substantially in a horizontal plane and extending between adjacent mounting structures with end portions of said connecting members in and engaging the respective mounting structures;

d. said mounting structures each having upper and lower bracket members with cooperating portions receiving and positioning end portions of respective connecting members, the connection of the mounting structure to the upper portion of the respective legs being to the lower bracket members with the end portions of the connecting members being substantially normal thereto;

e. means engaging the upper and lower brackets of each mounting means to secure same in clamping engagement with connecting member end portions therebetween to form the assembly of the mounting members and connecting members supported by legs under each mounting member; and f. selected furniture members mounted on and secured to each of the mounting members.

2. A modular tandem furniture structure as set forth in claim 1 wherein:

a. said connecting members are cylindrical tubular members and the mounting members provide the support and spacing thereof; and b. said furniture members include chair members each having a seat portion supported on and secured to the respective mounting structure.

3. A modular tandem furniture structure as set forth in claim 2 wherein:

a. each of said lower bracket members has a generally horizontal web portion connected to said respective leg member upper portion and opposed portions extending upwardly from said web portion to define a channel shaped member with the channel extending longitudinally relative to the connecting members:

b. each of said upwardly extending portions of each of said lower bracket members has a flange extending outwardly therefrom and adapted to have the seat portion of a respective one of said chair members mounted thereon; and c. each of said upper bracket members is positioned between said upwardly extending portions of said respective one of said lower bracket members.

4. A modular tandem furniture structure as set forth in claim 3 wherein:

a. said end portions of said plurality of connecting members each have at least one aperture therein; and b. each of said plurality of upper bracket members has a plurality of projections extending therefrom adapted to be received in a respective one of the apertures in the respective end portion of a respective one of said plurality of connection members.

5. A modular tandem furniture structure as set forth in claim 4 wherein:

a. the leg members are each one piece tubular members with the upper portion of each generally horizontal;

b. the base portion of each of said leg members is generally horizontal; and c. each of said leg members has an intermediate portion positioned rearwardly relative to the chair seat portions and extending between said base portion and said upper portion of the leg members to define a generally U-shaped member.

6. A modular tandem furniture structure as set forth in claim 3 wherein:

a. said leg members are one piece tubular members with the upper and lower portions forming free ends extending from a connecting intermediate portion in a direction that is forwardly relative to respective chair seat portions;

b. said mounting structures and connecting member end portions having cooperating interengaging portions preventing relative movement longitudinally of the connecting members and permitting limited rotative relative movement; and c. said tubular connecting members have substantial spacing and have longitudinal rigidity and torsional flexibility providing for resting support of the lower leg portion on uneven support surfaces while maintaining position of the seat portions.

* * * * *